US008100718B2

(12) United States Patent
Li et al.

(10) Patent No.: US 8,100,718 B2
(45) Date of Patent: Jan. 24, 2012

(54) EXTERNAL SATA CONNECTOR WITH DATA TERMINALS AND POWER-SUPPLY TERMINALS ON OPPOSITE SIDES OF A TERMINAL ACCOMMODATING SPACE OR A TERMINAL CARRYING PART

(75) Inventors: Dong Li, Beijing (CN); Fuqiang Li, Beijing (CN)

(73) Assignee: Beijing Huaqi Information Digital Technology Co., Ltd. (CN)

( * ) Notice: Subject to any disclaimer, the term of this patent is extended or adjusted under 35 U.S.C. 154(b) by 176 days.

(21) Appl. No.: 12/519,264

(22) PCT Filed: Apr. 24, 2007

(86) PCT No.: PCT/CN2007/001358

§ 371 (c)(1),
(2), (4) Date: Jun. 15, 2009

(87) PCT Pub. No.: WO2008/071049

PCT Pub. Date: Jun. 19, 2008

(65) Prior Publication Data

US 2010/0093213 A1 Apr. 15, 2010

(30) Foreign Application Priority Data

Dec. 15, 2006 (CN) ..... 2006 2 0167504 U
Dec. 31, 2006 (CN) ..... 2006 2 0173201 U

(51) Int. Cl.
*H01R 13/648* (2006.01)

(52) U.S. Cl. ..... 439/607.01

(58) Field of Classification Search ..... 439/607.01, 439/607.07, 357, 660, 668, 541.5
See application file for complete search history.

(56) References Cited

U.S. PATENT DOCUMENTS

| | | | | |
|---|---|---|---|---|
| 6,755,689 | B2 * | 6/2004 | Zhang et al. | 439/607.01 |
| 7,357,668 | B2 * | 4/2008 | Wan et al. | 439/541.5 |
| 7,704,081 | B2 * | 4/2010 | Swanger et al. | 439/79 |
| 2007/0077816 | A1 * | 4/2007 | Wan et al. | 439/607 |
| 2009/0137157 | A1 * | 5/2009 | Swanger et al. | 439/655 |
| 2009/0186529 | A1 * | 7/2009 | Chiang | 439/660 |
| 2009/0291597 | A1 * | 11/2009 | Nikazm et al. | 439/668 |

FOREIGN PATENT DOCUMENTS

| | | | |
|---|---|---|---|
| CN | 2922162 | | 7/2007 |
| CN | 2922162 | Y | 7/2007 |
| DE | 20 2005 016 572 | U1 | 2/2006 |
| DE | 202005016572 | | 3/2006 |
| JP | 2004-319372 | A | 11/2004 |
| JP | 2004319372 | | 11/2004 |
| JP | 200571848 | | 3/2005 |
| TW | 293552 | | 7/2006 |
| TW | 293552 | U | 7/2006 |

OTHER PUBLICATIONS

International Search Report dated Sep. 20, 2007, issued in corresponding international application No. PCT/CN2007/001358.

* cited by examiner

*Primary Examiner* — Chandrika Prasad
(74) *Attorney, Agent, or Firm* — Ostrolenk Faber LLP

(57) ABSTRACT

An eSATA connector includes a connector plug and a mated connector receptacle. The connector plug includes a plug member, a plug metal housing, plug data terminals and a terminal holding part, in which the plug data terminals are held, and further includes plug power terminals held in the terminal holding part, wherein the plug power terminals and the data terminals each other electrically insulated.

23 Claims, 10 Drawing Sheets

2B

EXTERNAL SATA CONNECTOR WITH DATA TERMINALS AND POWER-SUPPLY TERMINALS ON OPPOSITE SIDES OF A TERMINAL ACCOMMODATING SPACE OR A TERMINAL CARRYING PART

CROSS REFERENCE TO RELATED APPLICATIONS

The present application is a 35 U.S.C. §371 National Phase conversion of PCT/CN2007/001358, filed Apr. 24, 2007, which claims benefit of Chinese Application No. 200620167504.3, filed Dec. 15, 2006, and of Chinese Application No. 20060173201.2 filed Dec. 31, 2006, the disclosures of which are incorporated by reference herein. The PCT International Application was published in the Chinese language.

BACKGROUND

1. Technical Field

The invention relates to an eSATA interface connector, and in particular relates to an ESATA connector that integrates a data interface and a power-supply interface into a whole body.

2. Related Art

As daily development of the electronic technology, portable electronic devices are more and more widely used by the consumers. Requirements of vast data transmission promote relevant interface connector to support the vast data transmission, thus developing the SATA technology (namely, Serial Advanced Technology Attachment). However, SATA always cannot get involved in the mobile storage market in the mainstream market. Most of the computer systems and the retailed main boards are not equipped with a standard external SATA interface; moreover, since SATA cable can only be plugged for dozens of times, eSATA technology emerges because of demand under such a situation. Full name of eSATA is External Serial Advanced Technology Attachment, and eSATA is the external expansion specification of an SATA interface. In other words, eSATA is a SATA of an externally-arranged version, which is used for joining the external SATA devices rather than the internal SATA devices. For example, with an eSATA interface, an SATA hard disk can be easily connected with an eSATA interface of the main board, thereby being free from opening the case to replace the SATA hard disk. Compared with the SATA interface, the hardware specification of the eSATA is different, and a metal clip is added at the connection place of the data line interface to ensure the firmness of the physical connection. eSATA also supports the hot plugging. eSATA still adopts a seven-pin data line, so that the compatibility of the SATA device can be realized only by changing the interface.

Although eSATA has remarkable advantages on the aspect of application, eSATA still has weaknesses. eSATA is only provided with data interfaces and is lack of the power supply, namely, all devices based on eSATA interface are required to be equipped with additional power sources; moreover, if the user mistakes the plugging order of the data line and the power-supply wire during the hot plugging, the hot plugging function loses effectiveness and cannot be used, thereby influencing the performance of eSATA.

SUMMARY

The invention mainly aims at providing an eSATA connector. The simultaneous transmission of the power supply and the data can be realized through one connector without great improvement of the prior eSATA; moreover, the eSATA connector is convenient to be plugged at one time and has the advantages of having compact structure and saving connection space.

The invention provides the technical solution as follows:

An eSATA connector plug comprises:

a plug member;

a terminal accommodating space opened on the plug member;

a plug metal shell;

a plurality of plug data terminals accommodated inside the terminal accommodating space; and a plurality of plug power-supply terminals accommodated inside the terminal accommodating space; wherein the plug power-supply terminals are electrically insulated from the plug data terminals.

The plug power-supply terminals further comprises a plug voltage terminal and a plug grounding terminal, wherein, the plug voltage terminal is electrically insulated from the plug grounding terminal.

The plug data terminals and the plug power-supply terminals are respectively arranged on the opposite inner walls of the accommodating part of the plug member terminal.

The plug data terminals and the plug power-supply terminals are respectively arranged at the lower side surface and the upper side surface on the inner wall of the accommodating part of the plug member terminal.

An eSATA connector receptacle that matching with the eSATA connector plug comprises:

a receptacle member providing an accommodating recess;

a receptacle metal shell;

a terminal carrying part arranged inside the accommodating recess of the receptacle member;

a plurality of receptacle data terminals arranged on the terminal carrying part; and a plurality of receptacle power-supply terminals arranged on the terminal carrying part; wherein the receptacle data terminals are electrically insulated from the receptacle power-supply terminals.

The receptacle power-supply terminals comprise a receptacle voltage terminal and a receptacle grounding terminal, wherein, the receptacle voltage terminal is electrically insulated from the receptacle grounding terminal.

The receptacle data terminals and the receptacle power-supply terminals are respectively arranged on two side surfaces, which are opposite to each other, of the terminal carrying part.

The receptacle data terminals and the receptacle power-supply terminals are respectively arranged on the lower side surface and the upper side surface of the terminal carrying part.

The receptacle grounding terminal and the receptacle voltage terminal of the receptacle power-supply terminals are respectively arranged on the left side surface and the right side surface of the terminal carrying part.

As known from the above technical solution, the eSATA connector plug and receptacle are respectively provided with plug power-supply terminals and receptacle power-supply terminals on the terminal accommodating space and the terminal carrying part, so that two interfaces, a data interface and a power-supply interface, required by a connector plug are integrated into one interface; the connector that can realize the data transmission and the power transmission only through one plug and one receptacle has compact structure, thereby not only being convenient for user to carry and to install, but also reducing the installation space of the eSATA connector and the cost.

In addition, the data terminal of the eSATA connector plug of the invention is arranged to be matched with the prior standard eSATA connector receptacle; therefore, the eSATA connector plug and the eSATA connector receptacle of the invention can be matched with the prior standard eSATA connector receptacle and the prior standard eSATA connector plug, and can realize the data transmission or the power transmission without seriously modifying the prior standard eSATA connector receptacle and the prior eSATA connector plug.

DETAILED DESCRIPTION OF THE EMBODIMENT

The eSATA connector of the invention comprises a plug and a receptacle that is matched with the plug, and a power-supply terminal is additionally arranged in the plug and the receptacle of the data interface of the original eSATA connector, so that the data transmission and the power supply that is supplied to the eSATA connector interface can be simultaneously completed through the same interface. At the same time, when the eSATA connector plug and the receptacle of the invention are matched with each other for using, the power-supply terminal structure of the plug and receptacle conforms to the hot plugging rules, thereby the eSATA connector of the invention can ensure the normal application of the eSATA connector, and can prevent the inconvenient application problem of the prior eSATA connector requiring the data interface and the power-supply interface.

Figure 1:
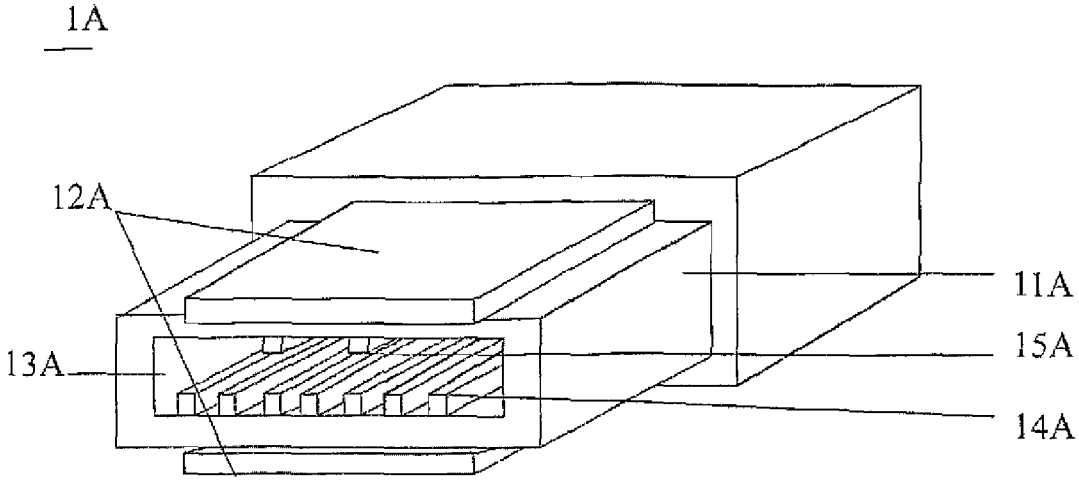
FIG. 1 shows the tri-dimensional schema of the structure of the eSATA connector plug of the first implementation example of the invention.
Figure 2:
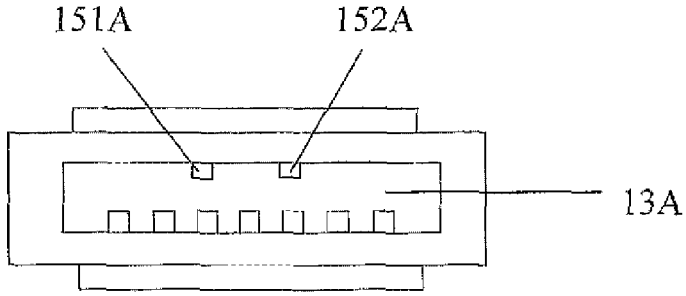
FIG. 2 shows the interface schema of FIG. 1 in the direction from A to A'.

An eSATA connector plug 1A of the first implementation example of the invention is shown in FIG. 1 and FIG. 2. The eSATA connector plug 1A includes an eSATA connector plug member 11A, a plug metal shell 12A of the plug member 11A, a plug member terminal accommodating space 13A set in the plug member 11A and seven plug data terminals 14A, wherein, seven plug data terminals 14A that are used for carrying out the data transmission are arranged at the inner side of the plug member terminal, and two plug power-supply terminals 15A that are used for connecting power source are arranged at the inner side surface of the plug member terminal accommodating space 13A corresponding to the inner side at which the plug data terminals 14A arranged. As shown in FIG. 2, the plug power-supply terminals 15A comprises a plug voltage terminal 151A and a plug grounding terminal 152A, and the two power-supply terminals are insulated to each other.

Figure 3:
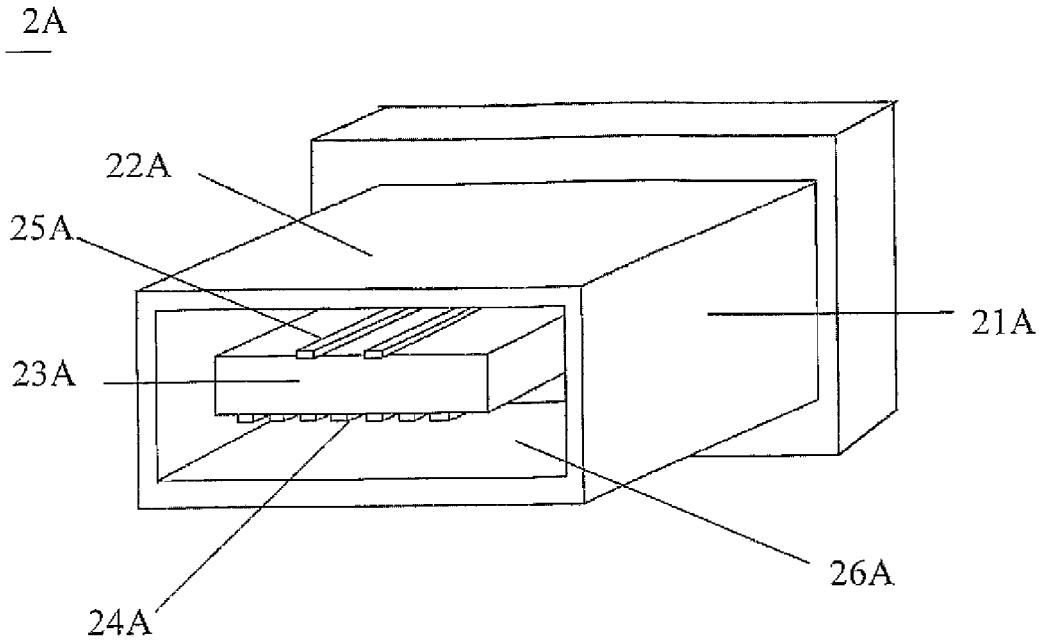
FIG. 3 shows the tri-dimensional schema of the structure of the eSATA connector receptacle of the first implementation example of the invention.
Figure 4:
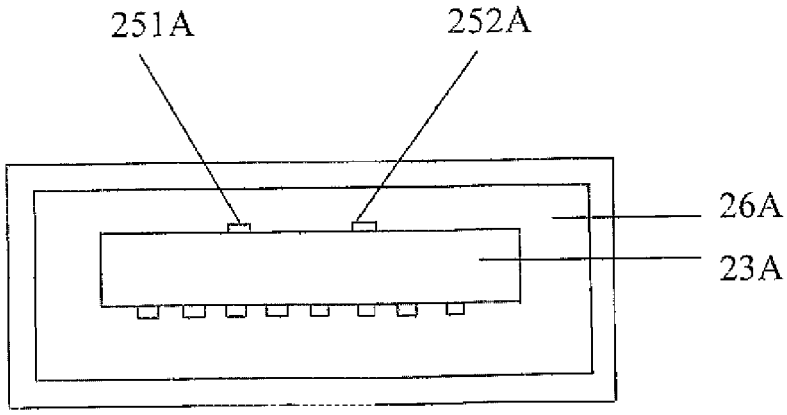
FIG. 4 shows the interface schema of FIG. 3 in the direction from B to B'.

An eSATA connector receptacle 2A corresponding to the eSATA connector plug of the first implementation example is shown in FIG. 3 and FIG. 4. The receptacle 2A comprises an eSATA connector receptacle member 21A, a receptacle metal shell 22A of the receptacle member 21A and a terminal carrying part 23A that is matched with the terminal accommodating space 13A of the eSATA connector plug member, wherein, the receptacle member 21A is provided with an accommodating recess 26A; the terminal carrying part 23A that is matched with the terminal accommodating space of the eSATA connector plug member is arranged inside the accommodating recess 26A of the receptacle member. Seven receptacle data terminals 24A that are used for the data transmission are arranged on the lower surface of the receptacle member terminal carrying part 23A; two receptacle power-supply terminals 25A that are used for supplying power to a eSATA device are arranged on the upper surface of the terminal carrying part 23A of the receptacle member. As shown in FIG. 4, the receptacle power-supply terminals 25A are provided with a receptacle voltage terminal 251A and a receptacle grounding terminal 252A. The plug data terminals 14A correspond to the receptacle data terminals 24A, and the plug power-supply terminals 15A correspond to the receptacle power-supply terminals 25A; moreover, in order to conform to the hot plugging rules of the interface, the receptacle power-connection terminal 251A and the receptacle grounding terminal 252A are slightly projected out the terminal carrying part 23A of the receptacle member, so that the receptacle power-supply terminals 25A terminal are ensured to be electrified first when the plug is plugged into the corresponding receptacle and then the plug data terminals 14A are contacted with the receptacle data terminals 24A.

Figure 5:
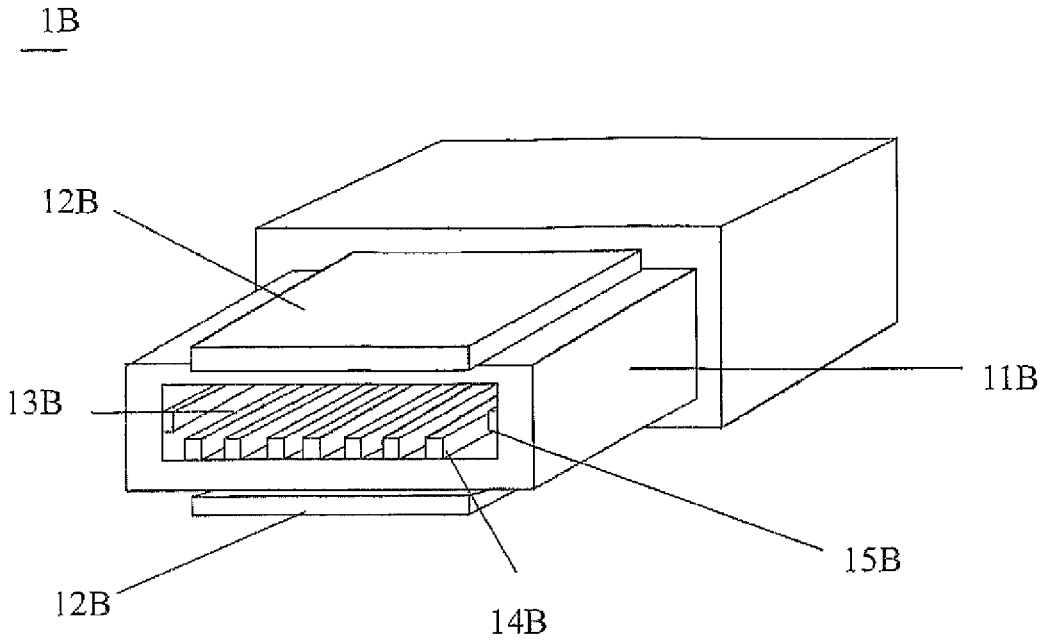
FIG. 5 shows the tri-dimensional schema of the structure of the eSATA connector of the second implementation example of the invention.
Figure 6:
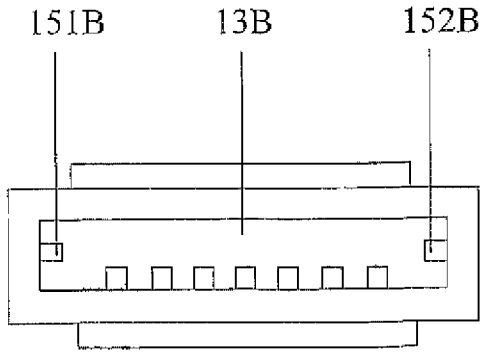
FIG. 6 shows the interface schema of FIG. 5 in the direction from A to A'.

An eSATA connector plug 1B of the second implementation example of the invention is shown in FIG. 5 and FIG. 6. The eSATA connector plug 1B includes an eSATA connector plug member 11B, a plug metal shell 12B of the plug member 11B and a terminal accommodating space 13B of the plug member, wherein, seven plug data terminals 14B that are used for the data transmission are arranged at the inner side of the terminal accommodating space 13B of the plug member. Different from the first implementation example, two plug power-supply terminals 15B that are used for connecting the power source are respectively arranged at two inner sides of the terminal accommodating space 13B of the plug member; as shown in FIG. 6, the plug power-supply terminals 15B are divided into a plug voltage terminal 151B and a plug grounding terminal 152B, and the two power-supply terminals are insulated to each other.

Figure 7:
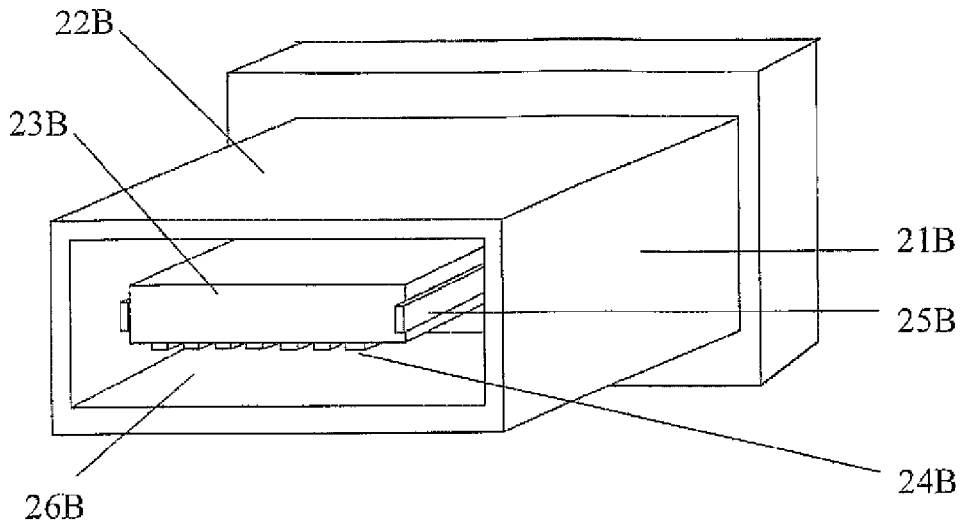
FIG. 7 shows the tri-dimensional schema of the structure of the eSATA connector receptacle of the second implementation example of the invention.
Figure 8:
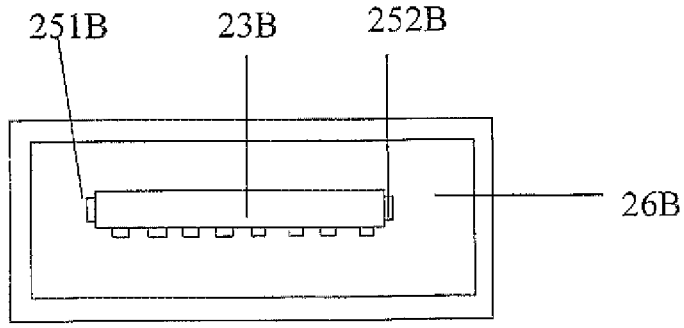
FIG. 8 shows the interface schema of FIG. 7 in the direction from B to B'.

An eSATA connector receptacle 2B that is correspondently plugged with the eSATA connector plug 1B of the second implementation example of the invention is shown in FIG. 7 and FIG. 8. The eSATA connector receptacle 2B includes an eSATA connector receptacle member 21B and a receptacle metal shell 22B of the receptacle member 21B and a terminal carrying part 23B that is matched with the terminal accommodating space of the eSATA connector plug member, wherein, the receptacle member 21B is provided with an accommodating recess 26B; the terminal carrying part 23B that is matched with the terminal accommodating space of the eSATA connector plug member is arranged inside the accommodating recess 26B of the receptacle member. Seven receptacle data terminals 24B that are used for the data transmission are arranged on the lower surface of the terminal carrying part 23B of the receptacle member; two receptacle power-supply terminals 25B that are used for supplying power to the eSATA device are respectively arranged on two side surfaces of the terminal carrying part 23B of the receptacle member. As shown in FIG. 8, the receptacle power-supply terminals 25B are provided with a receptacle voltage terminal 251B and a receptacle grounding terminal 252B. The plug data terminals 14B correspond to the receptacle data terminals 24B, and the plug power-supply terminals 15B correspond to the receptacle power-supply terminals 25B; moreover, in order to conform to the hot plugging rules, the receptacle voltage terminal 251B and the receptacle grounding terminal 252B are slightly projected out of the terminal carrying part 23B of the receptacle member compared with the receptacle data terminals 24B, so that the receptacle voltage terminal 251B and the receptacle grounding terminal 252B are ensured to be first electrified when the plug are plugged into the corresponding receptacle, and then the plug data terminals 14B is contacted with the receptacle data terminals 24B.

Figure 9:
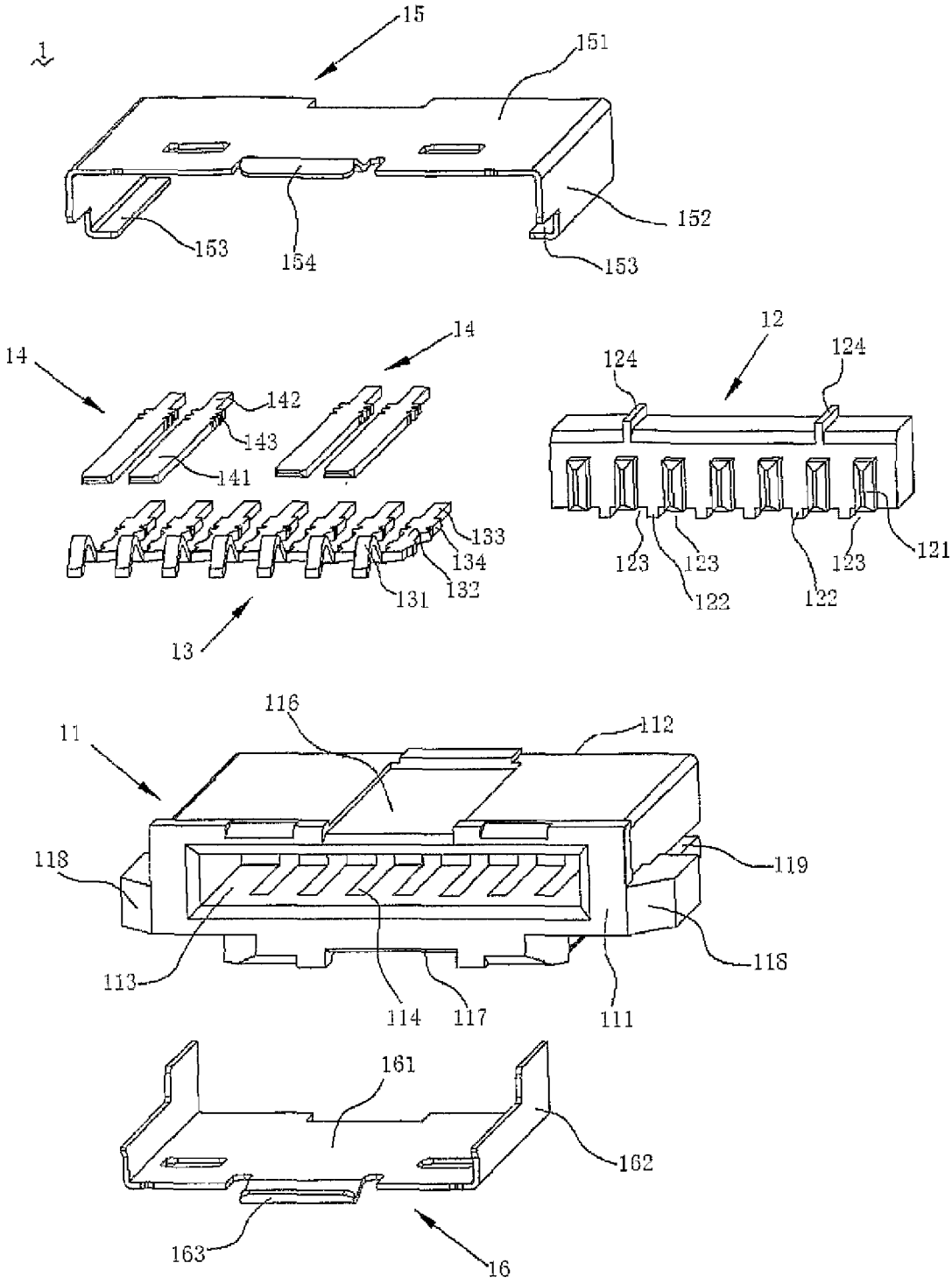
FIG. 9 shows the split decomposing diagram of the eSATA connector plug of the invention.
Figure 10:
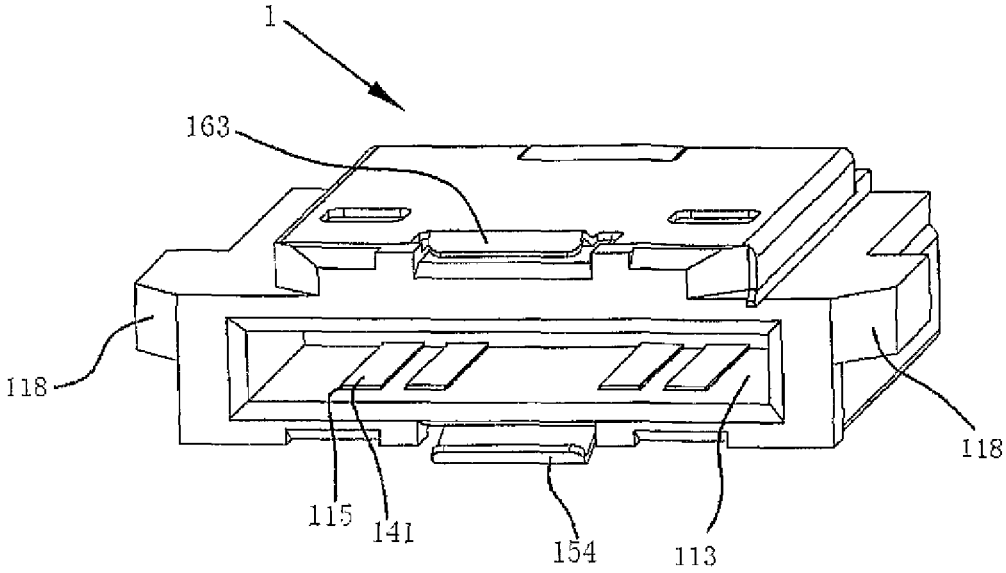
FIG. 10 shows the stereogram of the eSATA connector plug of the invention.
Figure 11:
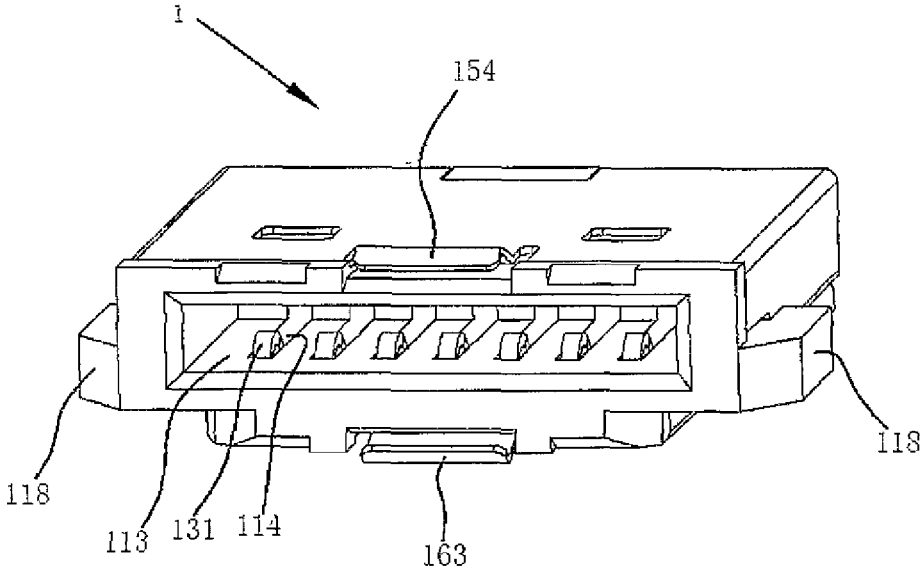
FIG. 11 shows another stereogram of the eSATA connector plug of the invention.

An eSATA connector plug 1 of the third implementation example of the invention is shown in FIG. 9, FIG. 10 and FIG. 11. The eSATA connector plug 1 includes a plug member 11, a plug terminal base 12 that is matched with the plug member 11, plug data terminals 13, plug power-supply terminals 14, and an upper shielding shell 15 and a lower shielding shell 16 which are locked with the plug member 1.

The plug member 11 comprises a front plugging side 111 and a rear plugging side 112, and a rectangular terminal accommodating space 113 is arranged on the front plugging side 111; the inner side of the bottom wall of the terminal accommodating space 113 is provided with a plurality of rectangular first terminal grooves 114; the first terminal grooves 114 extend backwards to pass through the rear plugging side 112 of the plug member 11. The inner side of the top wall of the terminal accommodating space 113 is provided with rectangular second terminal grooves 115, and the rear ends of the second terminal grooves 115 extend backwards to pass through the rear plugging side 112 of the plug member 11. The top end surface and the bottom end surface of the plug member 11 are respectively recessed to form a rectangular upper groove 116 and a rectangular upper groove 117; both outer sides of the plug member 11 are projected outwards to form holding blocks 118; both outer sides of the plug member, which located on the rear side of the holding blocks 118, are recessed to be provided with rectangular locking grooves 119.

The front end surface of the plug terminal base 12 extends forwards to form a projection 121, and the lower end surface of the plug terminal base 12 extends downwards to form a plurality of lugs 122 with a spaced distance; every two lugs 122 form an accommodating space 123; the upper end surface of the plug terminal base 12 is projected upwards to form two baffle ribs 124 that are separated from each other.

The plug data terminals 13 are data terminals and are used for transmitting the data signal of the eSATA; each plug data terminal 13 comprises an arc elastic part 131, a base part 132 and a welding tail part 133. The front end of the base part 132 extends forwards and bends upwards to form the elastic part 131, and the rear end of the base part 132 extends horizontally backwards to form the welding tail part 133. In order to ensure that the plug data terminals 13 are stably inserted into the plug member 11, both side edges of the rear end of the base part 132 extend outwards to form a dentate blocking part 134.

The plug power-supply terminals 14 are power-supply terminals and are used for transmitting the power-supply signal so as to supply the power that is required by the eSATA connector. In the implementation example, the quantity of the plug power-supply terminals 14 are in pairs; each pair of the plug power-supply terminals 14 can be respectively connected with a positive voltage signal end and a negative voltage signal end of an external power source. In real application, the power supply only requires one pair of the plug power-supply terminals 14; considering different voltage specifications of electronic products, one pair of the plug power-supply terminals 14 is provided for users to select. Each plug power-supply terminal 14 comprises a plugging end 141 and an integral welding end 142. The plugging end 141 is of a rectangular flat shape, and the rear end of the plugging end 141 extends backwards to form a tabular welding end 142. In order to stably insert the plug power-supply terminals 14 into the plug member 11, both side edges of the rear end of the plugging end 141 are projected outwards to form a dentate fixed part 143.

The upper shielding shell 15 comprises a rectangular lamellar upper shielding body 151 and an upper holding arm 152 that is formed by vertically bending and downwards extending both sides of the upper shielding body 151; the upper holding arm 152 is bent inwards to form a holding plate 153; the middle part of the upper shielding body 151 extends upwards to form an upper locking elastic trip 154.

The lower shielding shell 16 comprises a rectangular tabular lower shielding body 161 and a lower holding arm 162 that is formed by vertically upwards extending both sides of the lower shielding body 161, and the middle part of the lower shielding body 161 is projected downwards to form lower locking elastic trip 163.

Figure 12:
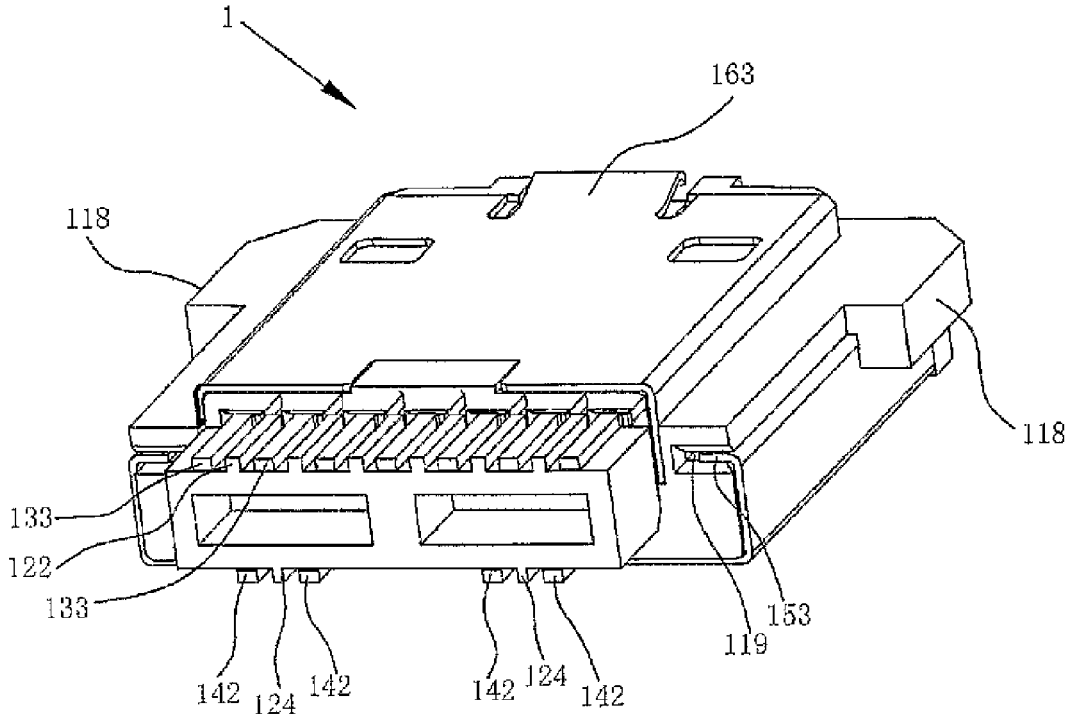
FIG. 12 shows another stereogram of the eSATA connector plug of the invention.

The tri-dimensional schema of the eSATA connector plug 1 after being assembled is shown in FIG. 10, FIG. 11 and FIG. 12. The rear plugging side of the plug member 11 is connected and fixedly assembled with the projection 121 on the front end surface of the plug terminal base 12. The elastic part 131 on the front end of each plug data terminal 13 is accommodated inside the first terminal grooves 114 of the plug member 11, and the arc end surface of the elastic part 131 extends out of the first terminal grooves 114, and the welding tail part 133 passes through the rear plugging side of the plug member 11 to be accommodated in the accommodating space 123 on the lower end surface of the plug terminal base 12, and every two adjacent plug data terminals 13 are insulated and separated by a lug 122 on the lower end surface of the plug terminal base 12; the blocking part 134 at both sides of the base part 132 of each plug data terminal 13 is embedded inside the first terminal grooves 114, so that the plug data terminals 13 can be stably inserted into the plug member 11. The plugging end 141 on the front end of each plug power-supply terminal 14 is accommodated into the second terminal grooves 115, and the welding end 142 extends backwards to pass through the rear plugging side 112 of the plug member 11 and to be accommodated on the upper end surface of the plug terminal base 12, and each pair of the plug power-supply terminals 14 are respectively arranged at both sides of the baffle rib 124, as shown in FIG. 12.

The holding plates 153 of the upper holding arms 152 of the upper shielding shell 15 are respectively embedded into the locking grooves 119 at both sides of the plug member 11 and is held by the plug member 11; the upper locking elastic trip 154 is locked and matched with the upper groove 116 of the plug member 11, and the upper locking elastic trip 154 extends out of the plane where the upper shielding body 151 is arranged. The lower holding arms 162 at both sides of the lower shielding shell 16 are locked and assembled with the lower end at both outer sides of the lower groove 117 of the plug member 11, and the lower locking elastic trip 163 extends out of the plane where the lower shielding body 161 is arranged. Therefore, the upper shielding shell 15 and the lower shielding shell 16 are respectively locked with the upper end and the lower end of the plug member 11 so as to screen the interference of the external signal and to simultaneously increase the stable holding force during the plugging.

Figure 13:
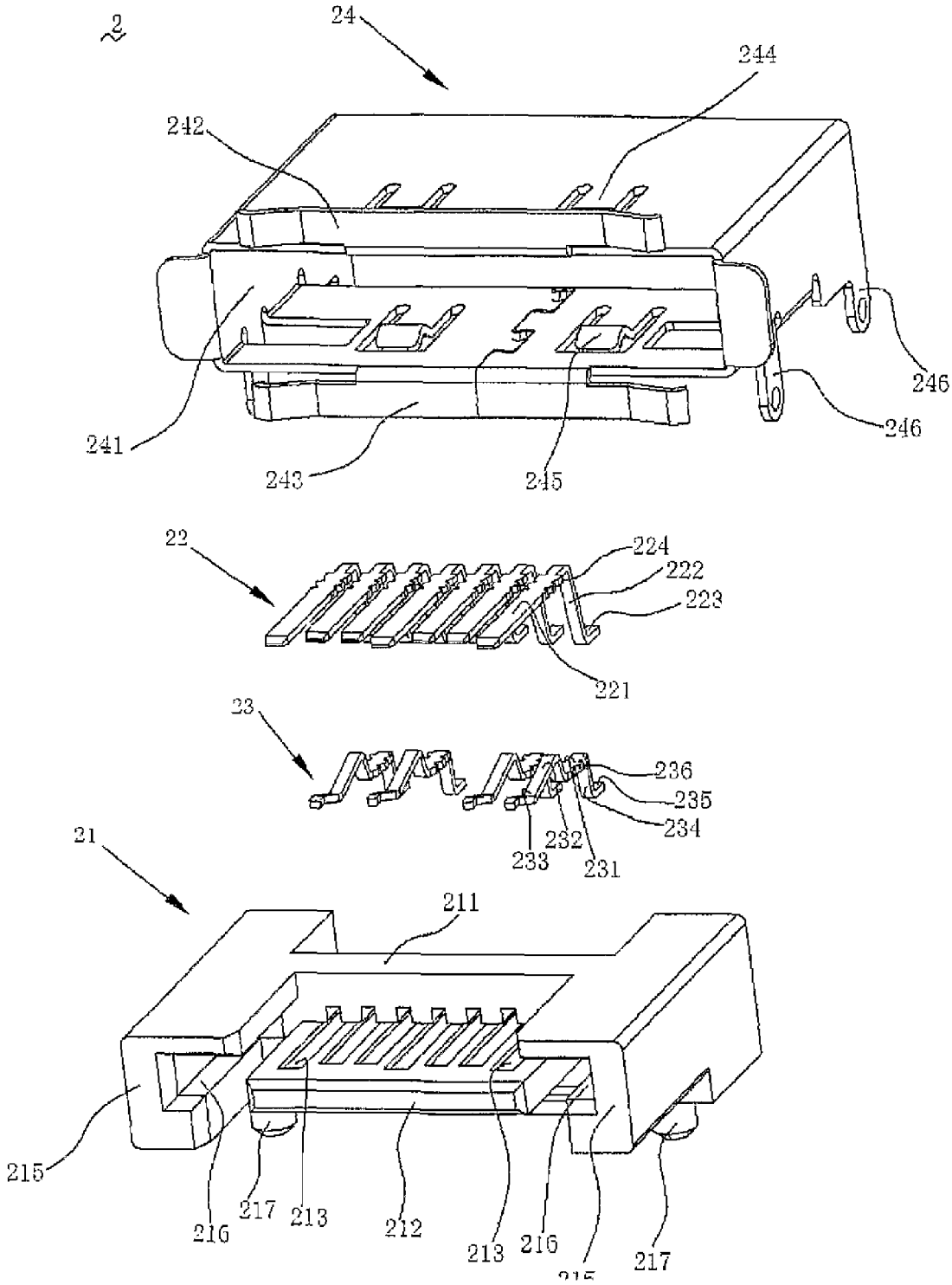
FIG. 13 shows the tri-dimensional exploded view of the eSATA connector receptacle of the invention.

Referring to FIG. 13, the exploded view of the connector receptacle 2 that is matched with the eSATA connector plug 1 of the third implementation example of the invention is shown as in the figure. The connector receptacle 2 comprises a receptacle member 21, receptacle data terminals 22, receptacle power-supply terminals 23 and a shielding shell 24.

Figure 14:
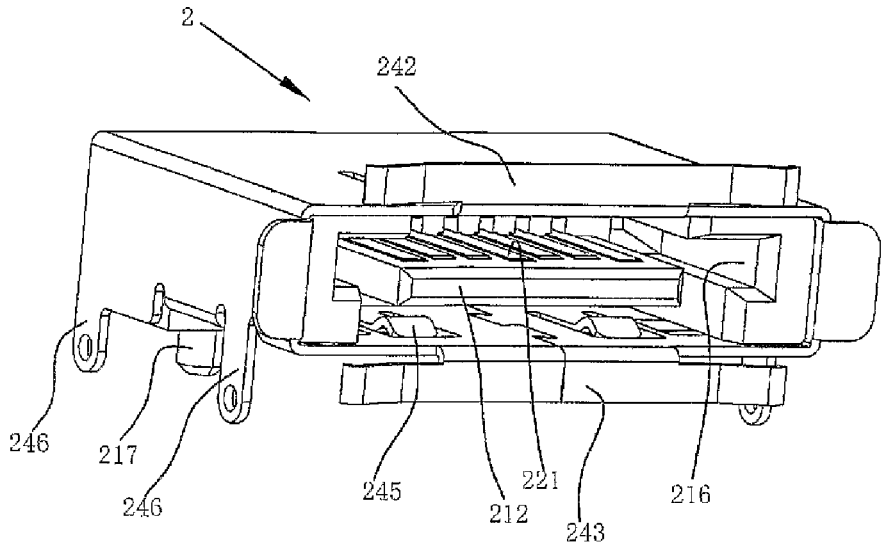
FIG. 14 shows the stereogram of the eSATA connector receptacle of the invention.
Figure 15:
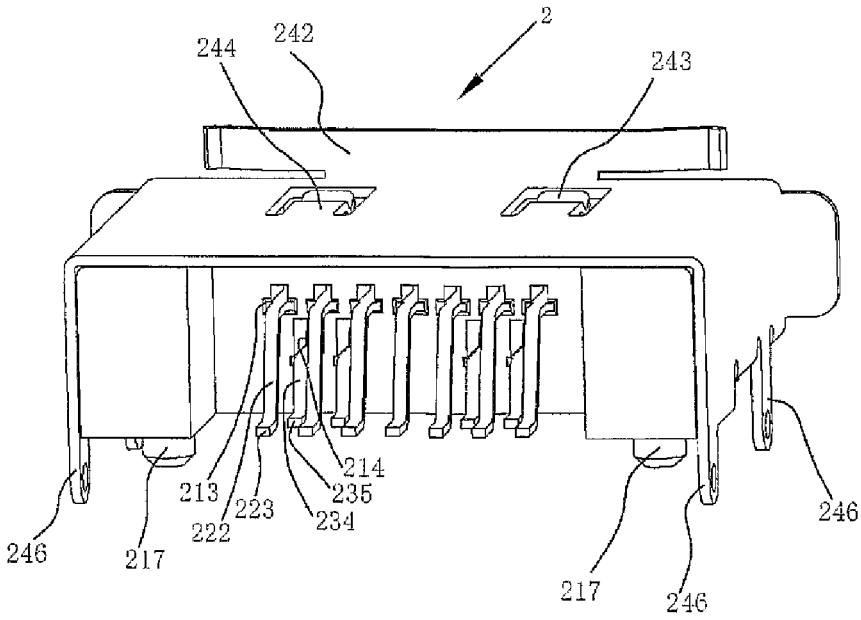
FIG. 15 shows another stereogram of the eSATA connector receptacle of the invention.

Referring to FIG. 14 and FIG. 15, the receptacle member 21 generally presents in an H-shaped structure and comprises a receptacle base 211, wherein, the middle part of the receptacle base 211 extends forwards to form a rectangular terminal base plate 212, and the upper end surface of the terminal base plate 212 is provided with a plurality of rectangular first accommodating grooves 213, and each first accommodating groove 213 extends backwards to pass through the rear end surface of the receptacle base 211, and the bottom end surface of the terminal base plate 212 is provided with a plurality of second accommodating grooves 214 (as shown in FIG. 15), and each second accommodating groove 214 extends backwards to pass through the rear end surface of the receptacle base 211. Both side ends of the receptacle base 211 are projected forwards and backwards to form a pair of holding bases 215, a pair of rectangular guiding grooves 216 are provided in the inner sides of the front end of each holding base 215. The lower end surface of the receptacle base 211 extends downwards to form a column-shaped positioning post 217.

The receptacle data terminals 22 are data terminals and are used for transmitting the data signal of the eSATA. Each receptacle data terminal 22 comprises a contact end 221 with the front end presenting in a rectangular plate shape, a connection end 222 that is formed by bending downwards and extending the rear end of the contact end 221, and a welding tail end 223 that is formed by bending backwards and horizontally extending the connection end 222, and in order to make the receptacle data terminals 22 stably inserted into the receptacle member 21, both side edges on the rear end of the contact end 221 are projected outwards to form a dentate holding part 224.

The receptacle power-supply terminals 23 are power-supply terminals, and are used for transmitting the power-supply signal required by the eSATA. In order to electrically matched with the plug power-supply terminals 14 of the eSATA connector plug 1 to supply power, in the implementation example, the quantity of the receptacle power-supply terminals 23 is two pairs, and each pair of the receptacle power-supply terminals 23 can be respectively connected with a positive voltage signal end and a negative voltage signal end of an external power source. Each receptacle power-supply terminal 23 comprises a tabular base plate part 231, and an arc bending part 232 that is bend upwards and is formed by extending the base plate part 231 forwards, wherein, the front end of the bending part 232 is bent downwards and extends forwards to form a guiding connection part 233, and the rear end of the base plate part 231 is bent downwards and extends to form a supporting part 234, and the rear end of the supporting part 234 is bent backwards and extends backwards to form a welding part 235. In order to ensure that the receptacle power-supply terminals 23 can be stably plugged into the receptacle member 21, both side edges on the rear end of the base plate part 231 are projected outwards to form an dentate embedding part 236.

The shielding shell 24 encircles a ferforated space 241 that is perforative from the front side to the rear side. The upper edge and the lower edge on the front end of the shielding shell 24 are respectively bent to form an upper baffle plate 242 and a lower baffle plate 243; the top wall and the bottom wall of the shielding shell 24 are respectively projected to form an upper elastic trip 244 and a lower elastic trip 245, and the lower end of the shielding shell 24 is vertically projected to form embedding plates 246 that could be plugged and fixed to external parts.

The stereogram of the eSATA connector receptacle 2 after being assembled is shown in FIG. 14 and FIG. 15. The contact end 221 on the front end of each receptacle data terminal 22 is plugged into the first accommodating grooves 213 of the terminal base plate 212, and the connection end 222 and the welding tail end 223 pass through the receptacle base 211 to extend out of the rear end surface of the receptacle base 211 so as to be welded with an external circuit; the holding part 224 is embedded into the first accommodating grooves 213 to be held by and connected with the receptacle member 21. The base plate part 231 of each receptacle power-supply terminal 23 is accommodated inside the second accommodating grooves 214, and the guiding connection part 233 is projected downwards and extends out of the second accommodating grooves 214, and the supporting part 234 and the welding part 235 pass through the receptacle base 211 and extend out of the rear end surface of the receptacle base 211 so as to be welded with an external circuit, and the embedding part 236 is embedded into the second accommodating grooves 214, so that the receptacle power-supply terminals 23 are stably plugged into the receptacle member 21. The ferforated space 241 of the shielding shell 24 is provided with the receptacle data terminals 22 and an receptacle member 21 of the receptacle power-supply terminals 23, thereby completing the assembling of the connector receptacle 2. In the implementation example, the welding tail end 223 of each receptacle data terminal 22, the welding part 235 of each receptacle power-supply terminal 23 of the connector receptacle 2 all adopt welding legs of an SMT structural mode. In addition, in the specific implementation, the welding legs of a DIP structural mode can also be adopted.

Figure 16:
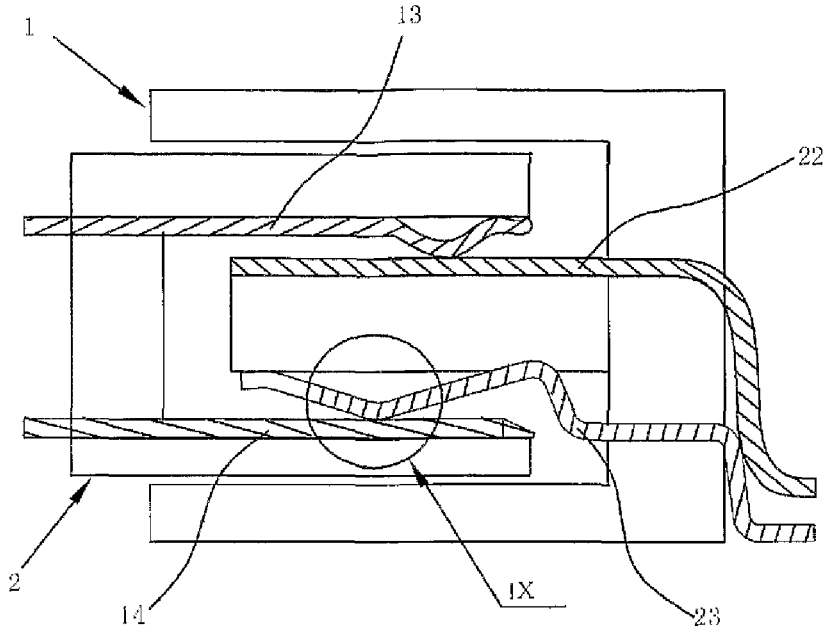
FIG. 16 shows the side sectional drawing after the eSATA connector plug is connected with a connector receptacle of the invention.

As shown in FIG. 16, when the connector plug 1 is plugged with the connector receptacle 2, the holding blocks 118 at both sides of the plug member 11 are respectively plugged into the connector receptacle 2 along with the guiding grooves 216 of the holding base; the elastic parts 131 of the plug data terminals 13 are contacted and electrically connected with the contact ends 221 of the receptacle data terminals 22; the plugging ends 141 of the plug power-supply terminals 14 are elastically contacted and electrically connected with the guiding connection parts 233 of the receptacle power-supply terminals 23. Therefore, the plug data terminals 13 are electrically connected with the receptacle data terminals 22 so as to transmit standard data signal of the eSATA; the plug power-supply terminals 14 are electrically connected with the receptacle power-supply terminals 23 so as to transmit power-supply signal that is required by the eSATA, thereby ensuring the required power supply between the connector plug 1 and the connector receptacle 2 based on the eSATA interface while performing the data transmission, so as to supply power for storage medium, medium peripheral control circuit and data transmission. In addition, the upper locking elastic trip 154 and the lower locking elastic trip 163 of the upper shielding shell 15 and the lower shielding shell 16 of the plug connector 1 are respectively and elastically pushed against the inner sides of the bottom wall and the top wall of the shielding shell 24 of the connector receptacle 2; at the same time, the upper and the lower elastic trip of the shielding shell 24 of the connector receptacle 2 are respectively and elastically pushed against the outer sides of the lower shielding shell 16 and the upper shielding shell 15, thereby providing reliable holding force between the connector plug 1 and the connector receptacle 2 and realizing the stable electrical connection.

To sum up, the connector plug 1 of the invention based on the eSATA interface is compatible with the standard eSATA interface; the eSATA connector plug 1 and the eSATA connector receptacle 2 of the invention can simultaneously transmit data signal and power source signal by adding the plug power-supply terminals 14 used for transmitting the power supply signal on the basis of the standard eSATA connector plug and arranging the receptacle power-supply terminals 23 used for transmitting the power source inside the receptacle member 21 of the eSATA connector receptacle 2 that is matched with the connector plug 1 and making the plug power-supply terminals 14 of the eSATA connector plug 1 plugged with the receptacle power-supply terminals 23 of the eSATA connector receptacle 2. Furthermore, user can complete the plugging at one time, thereby it is simple and convenient to be plugged.

In addition, of the prior art, the top wall of the plug member 11 with the thickness of 0.8 mm is easy to be deformed by the arc power-supply terminals with overstress, so that the shape of the top wall of the plug member can not be restored, thereby influencing the transmission of the power supply signal, and even making the power supply signal cannot be transmitted, and so the application of the eSATA is seriously influenced. The connector plug 1 of the invention based on the eSATA interface conforms to the standard of the eSATA interface, and the thickness of the top wall of the plug member 11 is 0.8 mm. The inner side of the top wall of the plug member 11 are provided with elastic arc power-supply terminals so as to increase the elastic contact tightness; when being contacted with the power-supply terminals of the connector receptacle 2, the elastic arc terminals are electrically contacted with the power-supply terminals of the receptacle, so that the arc power-supply terminals are stressed and transfers the acting force to the top wall of the plug member 11.

Figure 17:
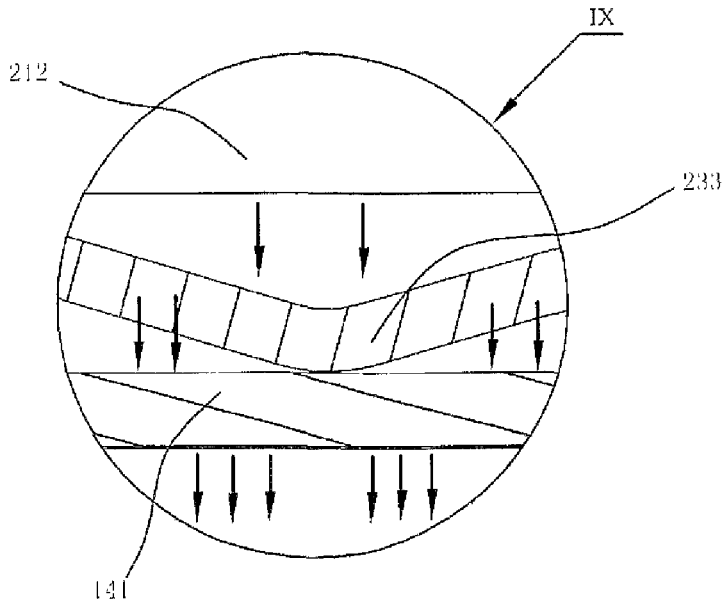
FIG. 17 shows the amplification schema of the IX position that is marked in FIG. 16 of the invention.

In the eSATA connector plug 1 of the invention, the tabular plug power-supply terminals 14 are arranged at the inner side of the top wall of the plug member 11; accordingly, the arc elastic receptacle power-supply terminals 23 are arranged inside the second accommodating grooves 214 on the lower end surface of the receptacle base plate 212 of the receptacle member 21; therefore, when the receptacle power-supply terminals 23 are contacted with the plug power-supply terminals 14, the elastic acting force of the guiding connection parts 233 of the arc receptacle power-supply terminals 23 is applied to the plug power-supply terminals 14, thereby being free from the acting force for the plugging; the tabular plug power-supply terminals 14 are easy to be scattered after being stressed, so that the top wall of the plug member 11 of the connector plug 1 is uniformly stressed and is uneasy to be damaged (the stress schema that is indicated by the arrow is shown in FIG. 17); the arc guiding connection part 233 is arranged on the terminal base plate 212 of the stable receptacle member 21 and supplies the elastic acting force during the contact, thereby preventing the easy damage caused by the concentrated stress on the top wall of the plug member 11.

The shapes of the connector plug and the connector receptacle are not limited to the plug and the receptacle defined by the prior eSATA in the implementation example; the plug and the receptacle of other shapes are within the protection range of the invention; at the same time, the arranging and the assembling ways of the data terminals and the power-supply terminals in the plug and of the data terminals and the power-supply terminals in the receptacle are not limited to the upper-lower arrangement ways mentioned above, and can be arranged in an annular way or an interval way.

The invention claimed is:

1. An external Serial Advanced Technology Attachment (eSATA) connector plug comprises:

a plug member;

a terminal accommodating space opened on the plug member;

a plug metal shell, provided on the outside of the plug member;

a plurality of plug data terminals accommodated inside the terminal accommodating space; and a plurality of plug power-supply terminals accommodated inside the terminal accommodating space; wherein the plug power-supply terminals are electrically insulated from the plug data terminals and the plug power-supply terminals are positioned opposite from the plug data terminals.

2. The eSATA connector plug as claimed in claim 1, wherein the plug power-supply terminals further comprise a plug voltage terminal and a plug grounding terminal, wherein, the plug voltage terminal is electrically insulated from the plug grounding terminal.

3. The eSATA connector plug as claimed in claim 1, wherein the plug data terminals and the plug power-supply terminals are respectively arranged on opposite inner walls of the terminal accommodating space.

4. The eSATA connector plug as claimed in claim 1, wherein the plug member further comprises a front plugging side and a rear plugging side, wherein, the front plugging side is provided with the terminal accommodating space, and an inner side of a bottom wall of the terminal accommodating space is provided with first terminal grooves;

each plug data terminal further comprises: a base part, an elastic part that is integrally formed on a front end of the base part, and a welding tail part that is integrally formed on the rear end of the base part;

the plug metal shell is a shielding shell and is locked with the plug member; and each plug power-supply terminal further comprises a plugging end and a welding end;

where an inner side of a top wall of the terminal accommodating space of the plug member is provided with second terminal grooves; and the plug power-supply terminals are arranged inside the second terminal grooves; and wherein the plug data terminals are data terminals that are used for transmitting data signal; and the plug power-supply terminals are power-supply terminals that are used for transmitting power-supply signal.

5. The eSATA connector plug as claimed in claim 4, wherein the plugging end of each plug power-supply terminal is of a tabular shape.

6. The eSATA connector plug as claimed in claim 5, wherein both side edges on a rear end of the plugging end of each plug power-supply terminal are projected outwards to form a dentate holding part.

7. The eSATA connector plug as claimed in claim 4, wherein a front end at both outer sides of the plug member is projected outwards to form a holding block.

8. The eSATA connector plug as claimed in claim 6, wherein the elastic part of each plug data terminal is of an arc shape, and both sides on the rear end of the base part are projected outwards to form a dentate locking part.

9. The eSATA connector plug as claimed in claim 8, wherein rear ends of the first terminal grooves extend backwards to pass through a rear plugging side of the plug member, and the welding tail part of each plug data terminal extends out of the rear plugging side of the plug member from the rear ends of the first terminal grooves, and the second terminal grooves extend backwards to pass through the rear plugging side of the plug member, and the welding end of each plug power-supply terminal extends out of the rear plugging side of the plug member from the rear ends of the second terminal grooves.

10. The eSATA connector plug as claimed in claim 4, wherein the metal shell is a shielding shell and comprises an upper shielding shell and a lower shielding shell.

11. The eSATA connector plug as claimed in claim 4, wherein the eSATA connector plug further comprises a plug terminal base; with a front end surface of the plug terminal base projected forwards to form a projection, and a lower end surface of the plug terminal base projected downwards to form lugs with a given spaced distance, and an upper end surface of the plug terminal base projected upwards to be provided with two baffle ribs that are separated from each other; where the front end surface of the plug terminal base is plugged into the rear plugging side of the plug member into a whole body; the welding tail part passes through the rear plugging side of the plug member and is accommodated inside the accommodating space on the lower end surface of the plug terminal base; and every two adjacent plug data terminals are insulated and separated from each other by the lugs on the lower end surface of the plug terminal base; and wherein the welding end of the plug power-supply terminal extends out of the rear plugging side of the plug member and is arranged on the upper end surface of the plug terminal base, and the plug power-supply terminals are respectively arranged on both sides of the baffle ribs.

12. An external Serial Advanced Technology Attachment connector receptacle matching with the eSATA connector plug of claim 1 comprises:

a receptacle member providing an accommodating recess;

a receptacle metal shell, provided on the outside of the receptacle member;

a terminal carrying part arranged inside the accommodating recess of the receptacle member;

a plurality of receptacle data terminals arranged on the terminal carrying part; and a plurality of receptacle power-supply terminals arranged on the terminal carrying part;

wherein the receptacle data terminals are electrically insulated from the receptacle power-supply terminals and the plurality of receptacle power-supply terminals are arranged opposite the plurality of receptacle data terminals.

13. The eSATA connector receptacle as claimed in claim 12, wherein the receptacle power-supply terminals further comprise a receptacle voltage terminal, and a receptacle grounding terminal; wherein the receptacle voltage terminal is electrically insulated from the receptacle grounding terminal.

14. The eSATA connector receptacle as claimed in claim 12, wherein the receptacle data terminals and the receptacle power-supply terminals are respectively arranged at two opposite side surfaces of the terminal carrying part.

15. The eSATA connector receptacle as claimed in claim 14, wherein the receptacle data terminals and the receptacle power-supply terminals are respectively arranged on a lower side surface and an upper side surface of the terminal carrying part.

16. The eSATA connector receptacle as claimed in claim 12, wherein the receptacle member further comprises:

a receptacle base projected forwards to form a terminal base plate, a plurality of first accommodating grooves disposed in the upper surface of the terminal base plate;

wherein, each receptacle data terminal includes a contacting end and a welding tail, the contacting end of each receptacle data terminal is inserted inside the first accommodating grooves;

the receptacle metal shell is assembled with the receptacle member as a shielding shell;

each receptacle power-supply terminal includes a base plate part, a guiding connection part and a welding part; the lower end surface of the terminal base plate of the receptacle member provides with a plurality of second accommodating grooves; the receptacle power-supply terminals are accommodated inside the second accommodating grooves; the receptacle data terminals are data terminals for transmitting data signal; the receptacle power-supply terminals are power-supply terminals for transmitting power-supply signal.

17. The eSATA connector receptacle as claimed in claim 16, wherein the guiding connection part of each receptacle power-supply terminal is bent to be arc-shape.

18. The eSATA connector receptacle as claimed in claim 16, wherein the base plate part of each receptacle power-supply terminal extends forward and bends upwards to form a bending part; the front end of the bending part is bent downwards to form the guiding connection part; the rear end of the base plate part is bent downwards to form a supporting part; the rear end of the supporting part is bent backwards and extends backwards to form the welding part.

19. The eSATA connector receptacle as claimed in claim 16, wherein both side edges of a rear end of the base plate part of each receptacle power-supply terminal project outwards to form a dentation embedding part.

20. The eSATA connector receptacle as claimed in claim 16, wherein a rear end of the contacting end of each receptacle data terminal bends downwards and extends to form a connection end; the connection end bends backwards and extends horizontally to form the welding tail; and both side edges of the rear end of the contacting end project outwards to form a dentation holding part.

21. The eSATA connector receptacle as claimed in claim 16, wherein the first accommodating grooves extend backwards to pass through the rear end surface of the receptacle base; the welding tail extends out of the rear end surface of the receptacle base from the rear ends of the first accommodating grooves; rear ends of the second accommodating grooves extend backwards to pass through the receptacle base; and the welding part of each power-supply terminal extends out of the rear end surface of the receptacle base from the rear ends of the second accommodating grooves.

22. The eSATA connector receptacle as claimed in claim 16, wherein both side ends of the receptacle base respectively project forwards and backwards to form a pair of holding bases; and a pair of guiding grooves are provided in the inner sides of the front end of each holding base.

23. The eSATA connector receptacle as claimed in claim 16, wherein an upper edge and a lower edge of a front end of the shielding shell respectively bends to form an upper baffle plate and an lower baffle plate; a top wall and a bottom wall of the shielding shell respectively projects to form an upper elastic trip and a lower elastic trip, a lower end of the shielding shell vertically projects to form an embedding plate; a lower end surface of the receptacle base vertically project downwards to form a plurality of positioning posts.

* * * * *